US012209837B1

(12) United States Patent
Madden

(10) Patent No.: US 12,209,837 B1
(45) Date of Patent: Jan. 28, 2025

(54) AUTOMATICALLY EJECTING MAGAZINE DEVICE

(71) Applicant: Christopher Madden, Phoenix, AZ (US)

(72) Inventor: Christopher Madden, Phoenix, AZ (US)

( * ) Notice: Subject to any disclaimer, the term of this patent is extended or adjusted under 35 U.S.C. 154(b) by 0 days.

(21) Appl. No.: 18/226,533

(22) Filed: Jul. 26, 2023

(51) Int. Cl.
*F41A 17/38* (2006.01)
*F41A 9/59* (2006.01)
*F41A 9/70* (2006.01)

(52) U.S. Cl.
CPC ..... *F41A 9/70* (2013.01)

(58) Field of Classification Search
CPC ..... F41A 9/59; F41A 9/62; F41A 9/65; F41A 9/70; F41A 9/61; F41A 17/36; F41A 17/38
See application file for complete search history.

(56) References Cited

U.S. PATENT DOCUMENTS

| | | | | |
|---|---|---|---|---|
| 5,473,834 | A | 12/1995 | Bammate | |
| D735,831 | S | 8/2015 | Faifer | |
| 10,168,116 | B1 | 1/2019 | Jen | |
| 10,337,812 | B2 | 7/2019 | Liao | |
| 10,508,874 | B2 | 12/2019 | Headrick | |
| 10,775,120 | B2 | 9/2020 | Harris | |
| 10,976,123 | B1 * | 4/2021 | Rich | F41A 17/38 |
| 11,143,474 | B2 * | 10/2021 | Maldonado | F41A 9/59 |
| 2009/0253103 | A1 * | 10/2009 | Hogan, Jr. | F41B 11/50 434/24 |
| 2016/0102931 | A1 * | 4/2016 | Roberts | F41A 9/70 89/33.02 |
| 2016/0348992 | A1 * | 12/2016 | Tisone | F41A 9/70 |
| 2020/0049437 | A1 * | 2/2020 | Chen | F41A 9/59 |
| 2020/0103188 | A1 * | 4/2020 | Jen | F41A 17/38 |
| 2021/0254916 | A1 * | 8/2021 | Czarnecki | F41A 19/01 |
| 2023/0266086 | A1 * | 8/2023 | Maga | F41A 9/65 42/70.02 |

FOREIGN PATENT DOCUMENTS

| | | |
|---|---|---|
| WO | WO2016193841 | 12/2016 |

* cited by examiner

*Primary Examiner* — Derrick R Morgan

(57) ABSTRACT

An automatically ejecting magazine device includes an ammunition magazine which is substantially hollow for receiving ammunition for a firearm. A follower is movably disposed within the ammunition magazine to support ammunition for the firearm and a magnet is attached to the follower. A door is hingedly attached to the ammunition magazine and the door has a recess which is engaged by a magazine release of the firearm to retain the ammunition magazine in the firearm. The magnet urges the door into a disengaged position such that the recess is not accessible to the magazine release. In this way the ammunition magazine can drop out of the firearm when the last round of ammunition is fed into the firearm.

11 Claims, 6 Drawing Sheets

AUTOMATICALLY EJECTING MAGAZINE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to automatic magazine devices and more particularly pertains to a new automatic magazine device for automatically ejecting an ammunition magazine from a firearm. The device includes an ammunition magazine and a door hingedly coupled to the ammunition magazine which has a recess integrated into the door. The door is biased into an engaging position to facilitate a magazine release in a firearm to engage the recess for retaining the ammunition magazine in the firearm. The device includes a magnet integrated into a follower of the magazine which urges the door into a disengaging position when the last round of ammunition is fed into the firearm thereby facilitating the ammunition magazine to drop out of the firearm.

(2) Description of Related Art Including Information Disclosed Under 37 CFR 1.97 and 1.98

The prior art relates to automatic magazine devices including a variety of automatically ejecting ammunition magazine devices which each includes some manner of ejection mechanism that involves active mechanical communication between a follower and an ejection device for automatically ejecting the ammunition magazine from a firearm when the last round of ammunition is fed into the firearm. In no instance does the prior art disclose an automatically ejecting ammunition magazine that employs a magnet for remotely actuating an ejection device to automatically eject the ammunition magazine from the firearm when the last round of ammunition is fed into the firearm.

BRIEF SUMMARY OF THE INVENTION

An embodiment of the disclosure meets the needs presented above by generally comprising an ammunition magazine which is substantially hollow for receiving ammunition for a firearm. A follower is movably disposed within the ammunition magazine to support ammunition for the firearm and a magnet is attached to the follower. A door is hingedly attached to the ammunition magazine and the door has a recess which is engaged by a magazine release of the firearm to retain the ammunition magazine in the firearm. The magnet urges the door into a disengaged position such that the recess is not accessible to the magazine release. In this way the ammunition magazine can drop out of the firearm when the last round of ammunition is fed into the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
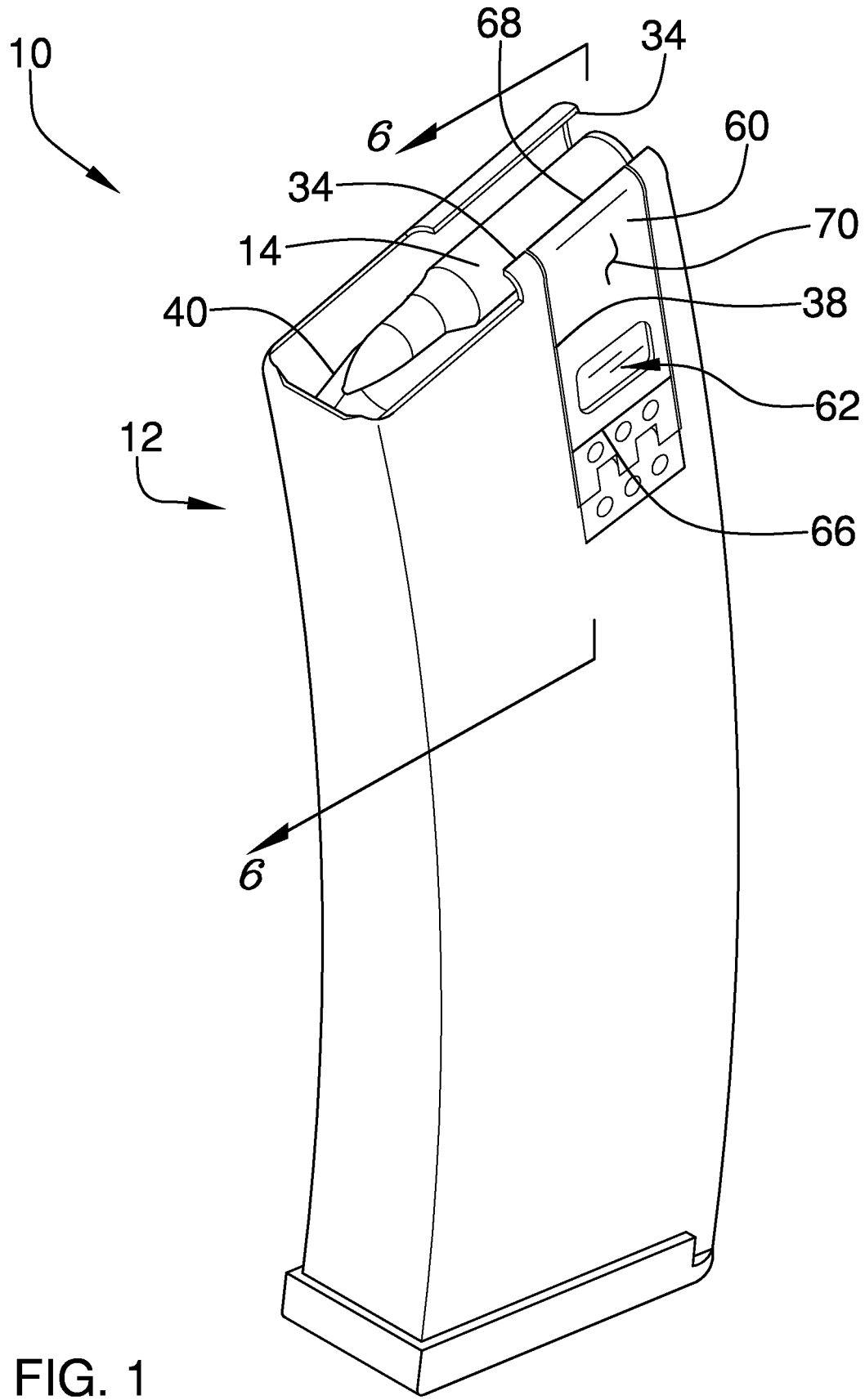
FIG. 1 is a top perspective view of an automatically ejecting magazine device according to an embodiment of the disclosure showing a door in an engaging position.
Figure 2:
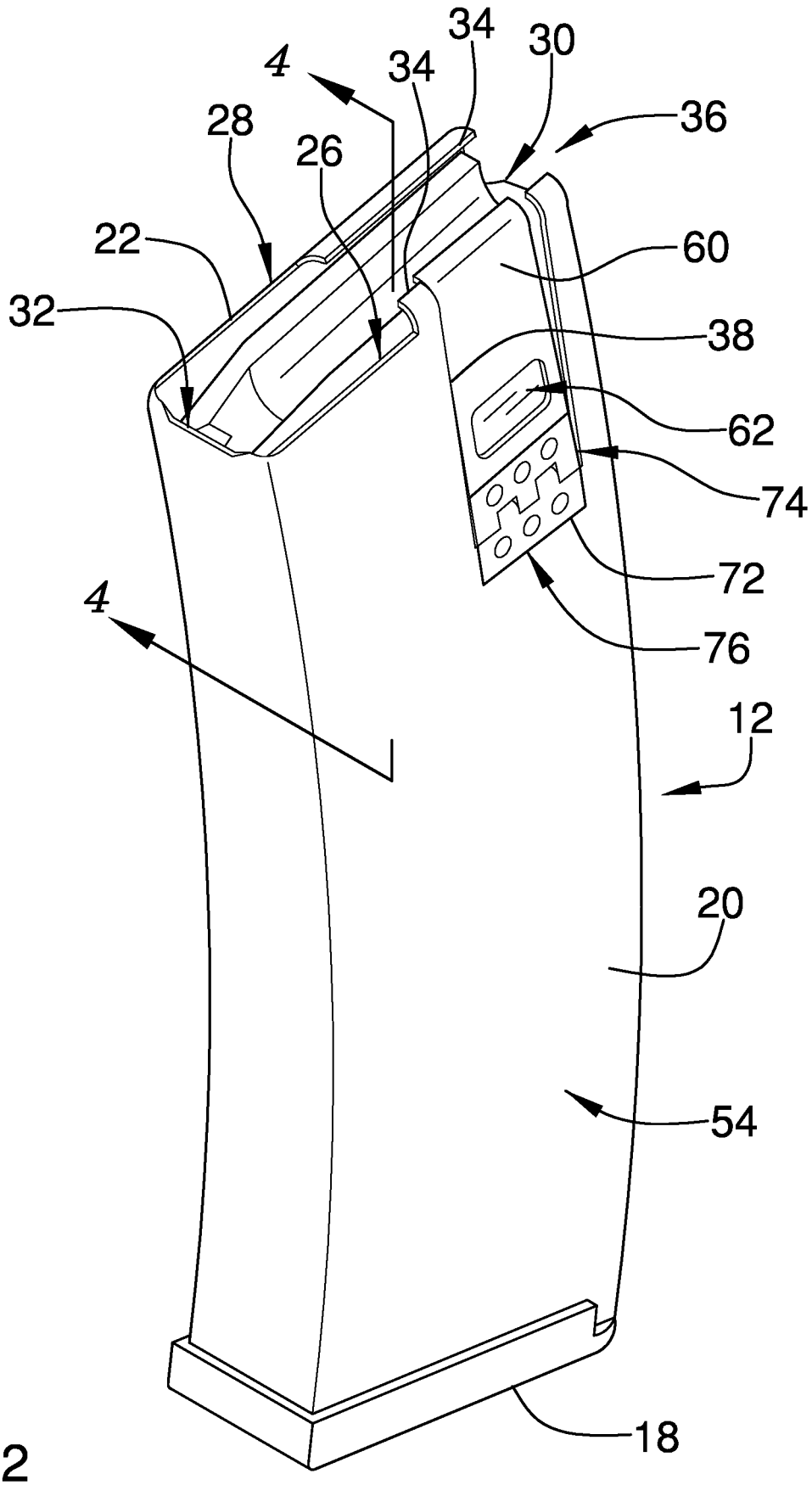
FIG. 2 is a perspective view of an embodiment of the disclosure showing a door in a disengaging position.
Figure 3:
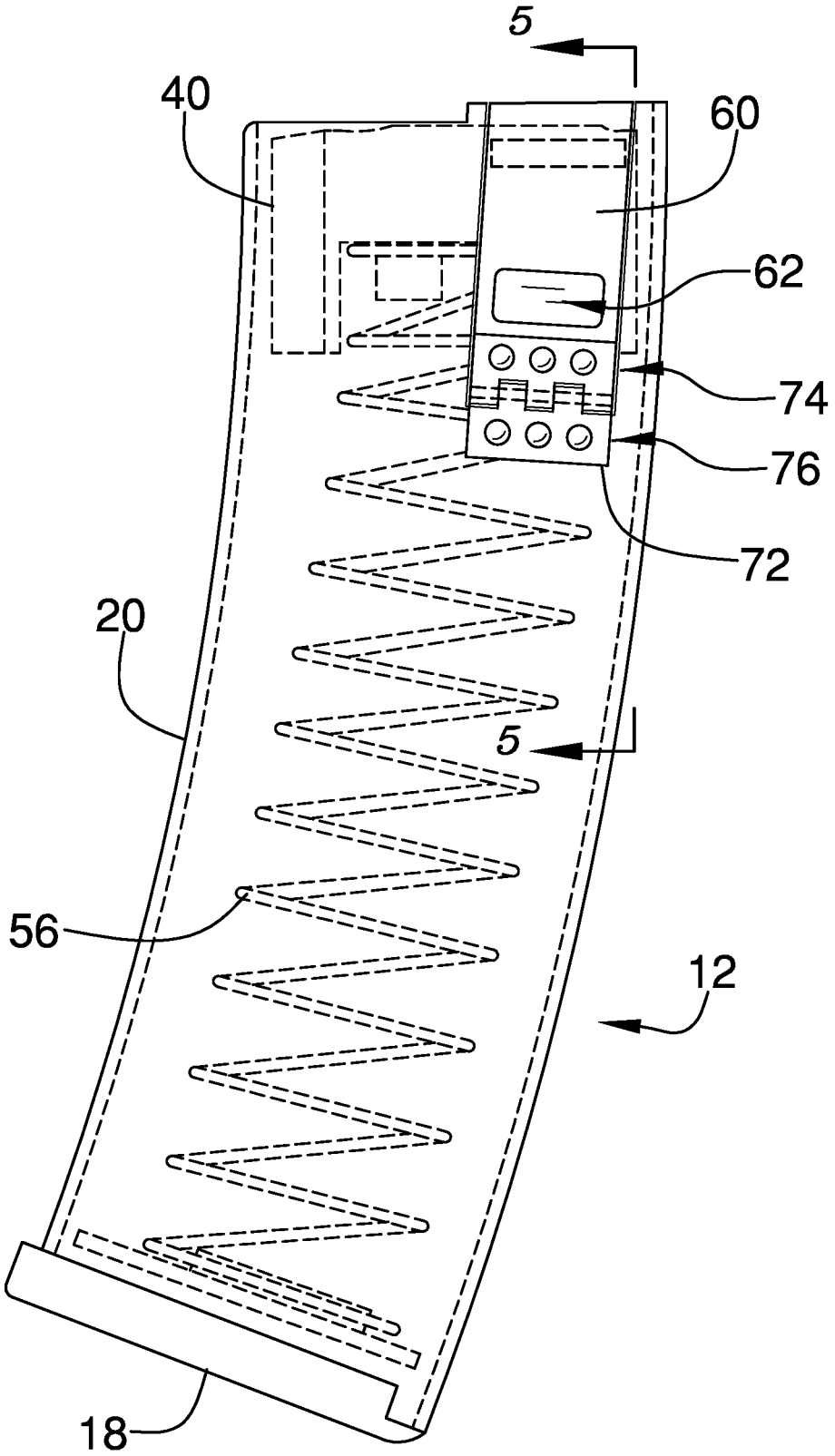
FIG. 3 is a left side phantom view of an embodiment of the disclosure.
Figure 4:
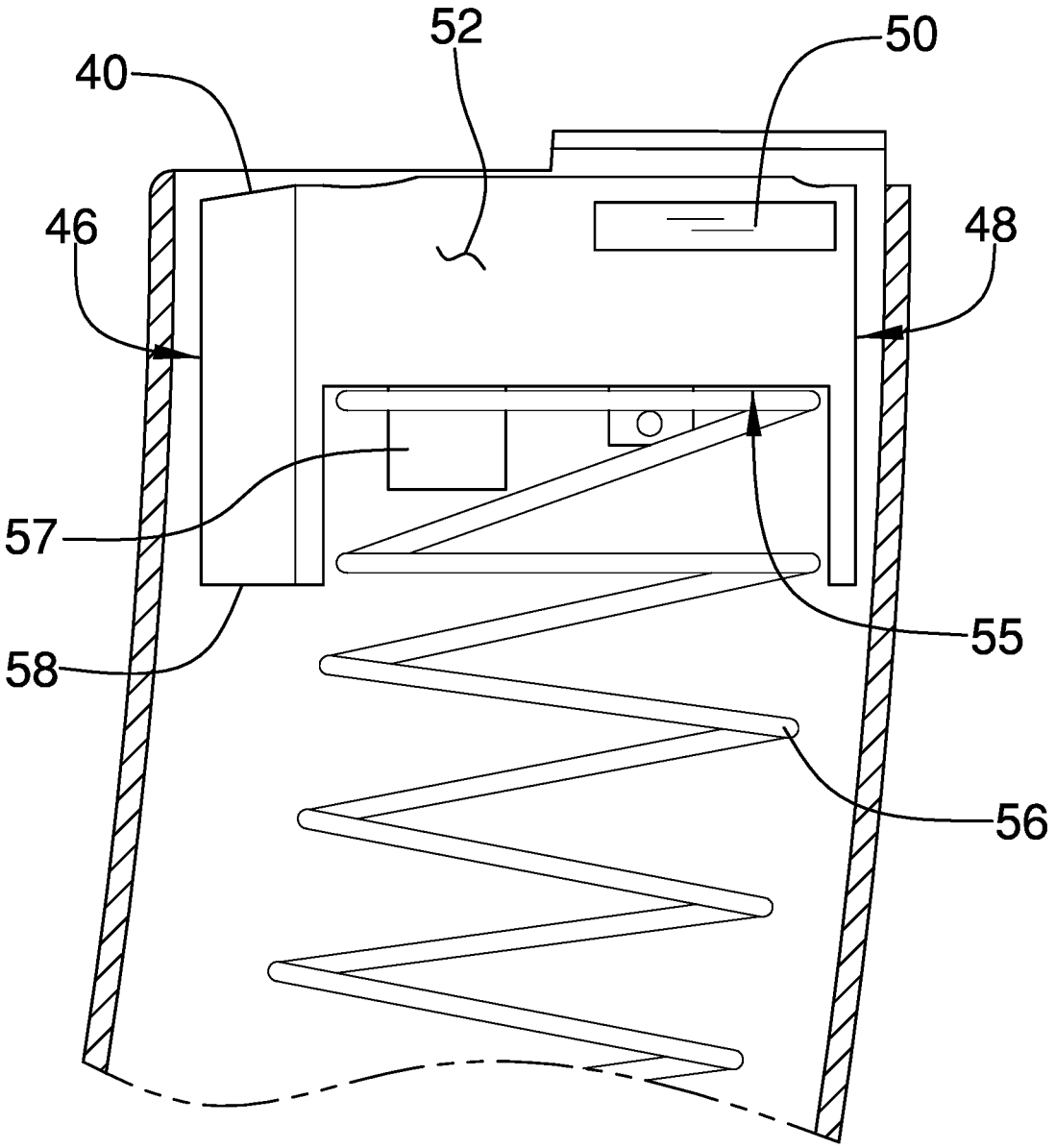
FIG. 4 is a cross sectional view taken along line 4-4 of FIG. 2 of an embodiment of the disclosure.
Figure 5:
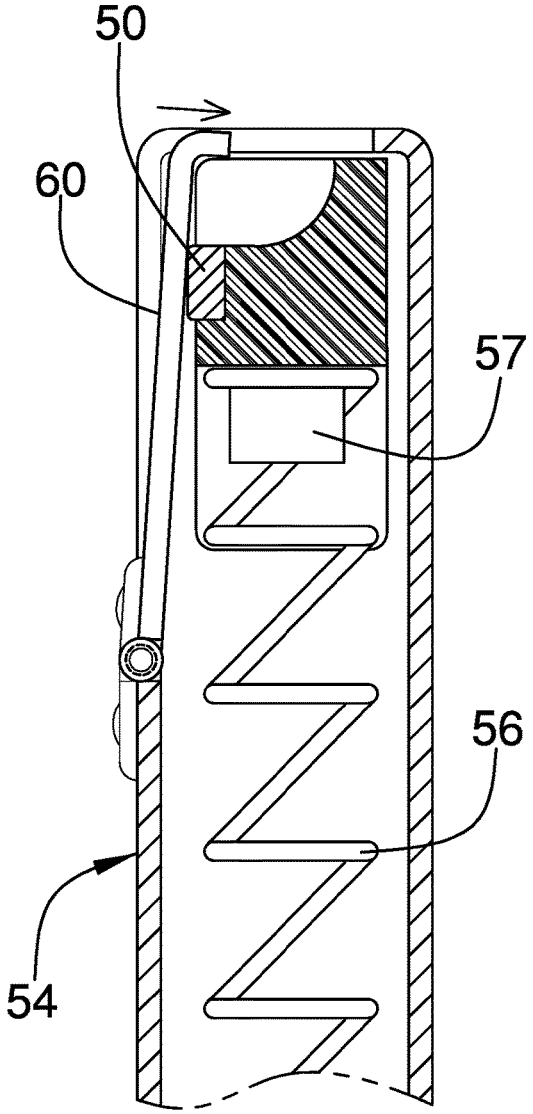
FIG. 5 is a cross sectional view taken along line 5-5 of FIG. 3 of an embodiment of the disclosure.
Figure 6:
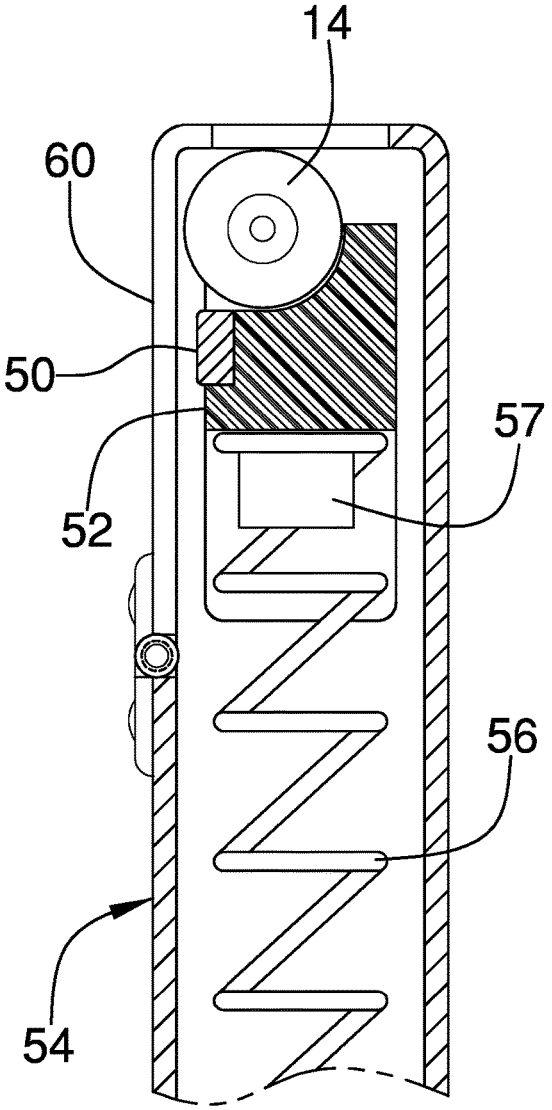
FIG. 6 is a cross sectional view taken along line 6-6 of FIG. 1 of an embodiment of the disclosure.
Figure 7:
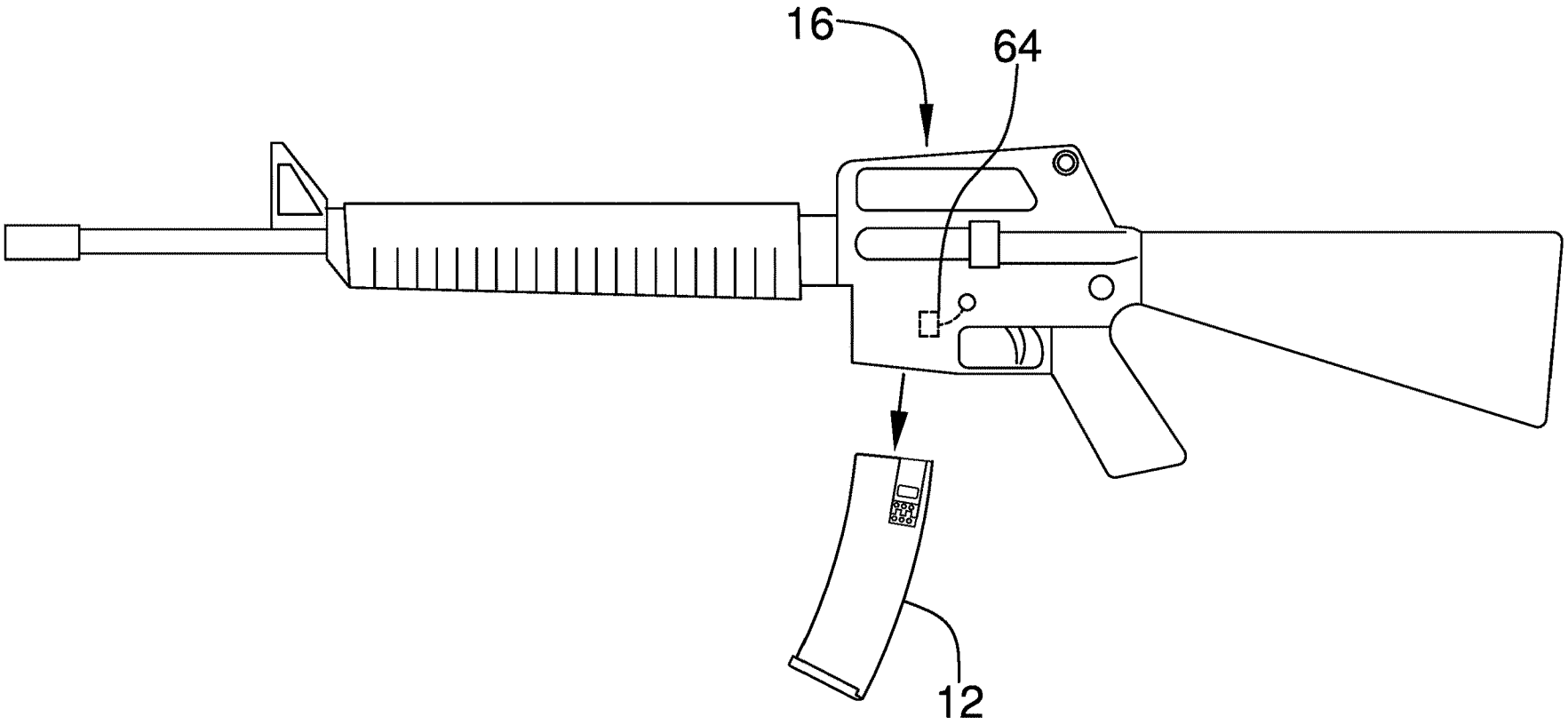
FIG. 7 is a perspective in-use view of an embodiment of the disclosure.

With reference now to the drawings, and in particular to FIGS. 1 through 7 thereof, a new automatic magazine device embodying the principles and concepts of an embodiment of the disclosure and generally designated by the reference numeral 10 will be described.

As best illustrated in FIGS. 1 through 7, the automatically ejecting magazine device 10 generally comprises an ammunition magazine 12 that is substantially hollow for receiving ammunition 14 for a firearm 16. The ammunition magazine 12 has a bottom wall 18 and an outer wall 20 extending upwardly from the bottom wall 18 and the outer wall 20 has a top edge 22 defining an opening 24 into an interior of the ammunition magazine 12. The top edge 22 has a first lateral side 26, a second lateral side 28, a back side 30 and a front side 32 and each of the first lateral side 26 and the second lateral side 28 has a lip 34 which curves toward each other. The lip 34 associated with each of the first lateral side 26 and the second lateral side 28 extends from the back side 30 toward the front side 32. Additionally, the back side 30 is spaced downwardly from each of the first lateral side 26 and the second lateral side 28 to define a bullet opening 36 between the first lateral side 26 and the second lateral side 28. The ammunition magazine 12 may comprise an ammunition magazine for a semi-automatic rifle of any convention design and size.

The outer wall 20 has a hole 38 extending into the interior of the ammunition magazine 12. The hole 38 extends from the lip 34 associated with the first lateral side 28 toward the bottom wall 18 and the hole 38 is positioned closer to the back side 30 than the front side 32. A follower 40 is movably disposed within the ammunition magazine 12 thereby facilitating the follower 40 to support ammunition 14 for the firearm 16. The follower 40 has a top surface 42 and the top surface 42 has a depression 44 extending between a front end 46 and a back end 48 of the follower 40. The depression 44 is concavely arcuate thereby facilitating the depression 44 to conform to curvature of the ammunition 14 for the firearm 16.

A magnet 50 is provided and the magnet 50 is attached to the follower 40. The magnet 50 is integrated into a lateral surface 52 of the follower 40 such that the magnet 50 is directed toward a first lateral side 54 of the outer wall 20 of the ammunition magazine 12. Additionally, the magnet 50 is positioned closer to the back end 48 of the follower 40 than the front end 46 of the follower 40. A biasing member 56 is positioned between the bottom wall 18 of the ammunition magazine 12 and a bottom surface 58 of the follower 40 such that the biasing member 56 biases the follower 40 to travel upwardly in the ammunition magazine 12. As is most clearly shown in FIG. 4, the bottom surface 58 of the follower has a recess 55 into which the biasing member 56 extends. Additionally, a knob 57 is positioned in the recess 55 around which the biasing member 56 extends for retaining the biasing member 56 in a preferred orientation on the follower 40.

A door 60 is hingedly attached to the ammunition magazine 12 and the door 60 has a recess 62 integrated into the door 60. The recess 62 can be engaged by a magazine release 64 of the firearm 16 when the ammunition magazine 12 is inserted into the firearm 16 for releasably retaining the ammunition magazine 12 in the firearm 16. The door 60 is biased into an engaged position having the door 60 lying flush with the ammunition magazine 12 such that the recess 62 is accessible to the magazine release 64 thereby facilitating the ammunition magazine 12 to be retained in the firearm 16. The magnet 50 urges the door 60 into a disengaged position having the door 60 angling inwardly into the ammunition magazine 12. Thus, the recess 62 is not accessible to the magazine release 64 thereby facilitating the ammunition magazine 12 to drop out of the firearm 16 when the last round of ammunition 14 is fed into the firearm 16.

The door 60 has a lower edge 66, an upper edge 68 and an outwardly facing surface 70 extending between the upper edge 68 and the lower edge 66. The door 60 is curved adjacent to the upper edge 68 such that the upper edge 68 is aligned with the lip 34 associated with the first lateral side 26 of the top edge 22 of the outer wall 20 of the ammunition magazine 12 when the door 60 is in the engaged position. The outwardly facing surface 70 is oriented flush with the first lateral side 26 of the outer wall 20 of the ammunition magazine 12 when the door 60 is in the engaged position. Conversely, the outwardly facing surface 70 is spaced inwardly from the first lateral side 26 of the outer wall 20 having the upper edge 68 being spaced inwardly from the lip 34 associated with the first lateral side 26 of the top edge 22 of the outer wall 20 when the door 60 is in the disengaged position. The magnet 50 on the follower 40 is aligned with the door 60 when the follower 40 is biased into a topmost position when the last round of ammunition 14 is fed into the firearm 16.

A hinge 72 is included which has a first portion 74 that hingedly engages a second portion 76. The first portion 74 is attached to the outwardly facing surface 70 of the door 60 and the second portion 76 is attached to the first lateral side 26 of the outer wall 20 of the ammunition magazine 12. The hinge 72 is biased into an open position having the first portion 74 being oriented coplanar with the second portion 76. The hinge 72 is urgeable into a closed position having the first portion 74 being oriented at an angle with the second portion 76.

In use, the ammunition magazine 12 is loaded with ammunition 14 and the ammunition magazine 12 is inserted into the firearm 16. The magazine release 64 in the firearm 16 engages the recess 62 in the door 60 to retain the ammunition magazine 12 in the firearm 16. The magnet 50 in the follower 40 is aligned with the door 60 once the last round of ammunition 14 is fed into the firearm 16. In this way the strength of the magnetic attraction of the magnet 50 overcomes the biasing strength of the hinge 72 to urge the door 60 into the disengaged position. Thus, the recess 62 is disengaged from the magazine release 64 and the ammunition magazine 12 falls from the firearm 16. In this way the empty ammunition magazine 12 is automatically ejected from the firearm 16 to facilitate a loaded ammunition magazine 12 to be inserted into the firearm 16. Furthermore, the magnet 50 facilitates the door 60 to be urged into the disengaging position without requiring mechanical communication between the follower 40 and the door 60 thereby reducing the likelihood of a mechanical failure that would prevent the ammunition magazine 12 from automatically ejecting from the firearm 16.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatically ejecting magazine device which is automatically ejected from a firearm when the last bullet has been fired, said device comprising:

an ammunition magazine being substantially hollow for receiving ammunition for a firearm;

a follower being movably disposed within said ammunition magazine thereby facilitating said follower to support ammunition for said firearm;

a magnet being attached to said follower;

a door being hingedly attached to said ammunition magazine, said door having a recess integrated into said door; said recess configured to be engaged by a magazine release of said firearm when said ammunition magazine is inserted into said firearm for releasably retaining said ammunition magazine in said firearm, said door being biased into an engaged position having said door lying flush with said ammunition magazine such that said recess is accessible to said magazine release thereby facilitating said ammunition magazine to be retained in said firearm, said magnet urging said door into a disengaged position wherein said door angles inwardly into said ammunition magazine such that said recess cannot be engaged by said magazine release thereby facilitating said ammunition magazine to drop out of said firearm when the last round of ammunition is fed into said firearm.

2. The device according to claim 1, wherein:

said ammunition magazine has a bottom wall and an outer wall extending upwardly from said bottom wall, said outer wall having a top edge defining an opening into an interior of said ammunition magazine, said top edge having a first lateral side, a second lateral side, a back side and a front side;

each of said first lateral side and said second lateral side has a lip which curves toward each other, said lip associated with each of said first lateral side and said second lateral side extending from said back side toward said front side;

said back side is spaced downwardly from each of said first lateral side and said second lateral side to define a bullet opening between said first lateral side and said second lateral side; and said outer wall has a hole extending into said interior of said ammunition magazine, said hole extending from said lip associated with said first lateral side toward said bottom wall, said hole being positioned closer to said back side than said front side.

3. The device according to claim 2, wherein said follower has a top surface, said top surface having a depression extending between a front end and a back end of said follower, said depression being concavely arcuate thereby facilitating said depression to conform to curvature of the ammunition for said firearm.

4. The device according to claim 1, wherein said magnet is integrated into a lateral surface of said follower such that said magnet is directed toward a first lateral side of an outer wall of said ammunition magazine, said magnet being positioned closer to said back end of said follower than said front end of said follower.

5. The device according to claim 1, further comprising a biasing member being positioned between a bottom wall of said ammunition magazine and a bottom surface of said follower such that said biasing member biases said follower to travel upwardly in said ammunition magazine.

6. The device according to claim 2, wherein said door has a lower edge, an upper edge and an outwardly facing surface extending between said upper edge and said lower edge, said door being curved adjacent to said upper edge such that said upper edge is aligned with said lip associated with said first lateral side of said top edge of said outer wall of said ammunition magazine when said door is in said engaged position.

7. The device according to claim 6, wherein said outwardly facing surface is oriented flush with said first lateral side of said outer wall of said ammunition magazine when said door is in said engaged position.

8. The device according to claim 6, further wherein said outwardly facing surface is spaced inwardly from said first lateral side of said outer wall having said upper edge being spaced inwardly from said lip associated with said first lateral side of said top edge of said outer wall when said door is in said disengaged position.

9. The device according to claim 1, wherein said magnet on said follower is aligned with said door when said follower is biased into a topmost position when the last round of ammunition is fed into said firearm.

10. The device according to claim 6, wherein:

said device includes a hinge having a first portion hingedly engaging a second portion;

said first portion is attached to said outwardly facing surface of said door;

said second portion is attached to said first lateral side of said outer wall of said ammunition magazine;

said hinge is biased into an open position having said first portion being oriented coplanar with said second portion; and said hinge is urgeable into a closed position having said first portion being oriented at an angle with said second portion.

11. An automatically ejecting magazine device which is automatically ejected from a firearm when the last bullet has been fired, said device comprising:

an ammunition magazine being substantially hollow for receiving ammunition for a firearm, said ammunition magazine having a bottom wall and an outer wall extending upwardly from said bottom wall, said outer wall having a top edge defining an opening into an interior of said ammunition magazine, said top edge having a first lateral side, a second lateral side, a back side and a front side, each of said first lateral side and said second lateral side having a lip which curves toward each other, said lip associated with each of said first lateral side and said second lateral side extending from said back side toward said front side, said back side being spaced downwardly from each of said first lateral side and said second lateral side to define a bullet opening between said first lateral side and said second lateral side, said outer wall having a hole extending into said interior of said ammunition magazine, said hole extending from said lip associated with said first lateral side toward said bottom wall, said hole being positioned closer to said back side than said front side;

a follower being movably disposed within said ammunition magazine thereby facilitating said follower to support ammunition for said firearm, said follower having a top surface, said top surface having a depression extending between a front end and a back end of said follower, said depression being concavely arcuate thereby facilitating said depression to conform to curvature of the ammunition for said firearm;

a magnet being attached to said follower, said magnet being integrated into a lateral surface of said follower such that said magnet is directed toward a first lateral side of said outer wall of said ammunition magazine, said magnet being positioned closer to said back end of said follower than said front end of said follower;

a biasing member being positioned between said bottom wall of said ammunition magazine and a bottom surface of said follower such that said biasing member biases said follower to travel upwardly in said ammunition magazine;

a door being hingedly attached to said ammunition magazine, said door having a recess integrated into said door; said recess configured to be engaged by a magazine release of said firearm when said ammunition magazine is inserted into said firearm for releasably retaining said ammunition magazine in said firearm, said door being biased into an engaged position having said door lying flush with said ammunition magazine such that said recess is accessible to said magazine release thereby facilitating said ammunition magazine to be retained in said firearm, said magnet urging said door into a disengaged position wherein said door angles inwardly into said ammunition magazine such that said recess cannot be engaged by said magazine release thereby facilitating said ammunition magazine to drop out of said firearm when the last round of ammunition is fed into said firearm, said door having a lower edge, an upper edge and an outwardly facing surface extending between said upper edge and said lower edge, said door being curved adjacent to said upper edge such that said upper edge is aligned with said lip associated with said first lateral side of said top edge of said outer wall of said ammunition magazine when said door is in said engaged position, said outwardly facing surface being oriented flush with said first lateral side of said outer wall of said ammunition magazine when said door is in said engaged position, said outwardly facing surface being spaced inwardly from said first lateral side of said outer wall having said upper edge being spaced inwardly from said lip associated with said first lateral side of said top edge of said outer wall when said door is in said disengaged position, said magnet on said follower being aligned with said door when said follower is biased into a topmost position when the last round of ammunition is fed into said firearm; and a hinge having a first portion hingedly engaging a second portion, said first portion being attached to said outwardly facing surface of said door, said second portion being attached to said first lateral side of said outer wall of said ammunition magazine, said hinge being biased into an open position having said first portion being oriented coplanar with said second portion, said hinge being urgeable into a closed position having said first portion being oriented at an angle with said second portion.

* * * * *